US006254394B1

(12) United States Patent
Draper et al.

(10) Patent No.: US 6,254,394 B1
(45) Date of Patent: Jul. 3, 2001

(54) AREA WEAPONS EFFECT SIMULATION SYSTEM AND METHOD

(75) Inventors: Robert L. Draper, San Diego; Dennis D. Rogers, El Cajon, both of CA (US)

(73) Assignee: Cubic Defense Systems, Inc., San Diego, CA (US)

( * ) Notice: Subject to any disclaimer, the term of this patent is extended or adjusted under 35 U.S.C. 154(b) by 0 days.

(21) Appl. No.: 08/988,019

(22) Filed: Dec. 10, 1997

(51) Int. Cl.[7] ..... F41G 3/26

(52) U.S. Cl. ..... 434/11; 434/12; 434/23

(58) Field of Search ..... 273/371, 372, 273/310, 311; 367/906; 235/400, 412; 434/1, 6, 9, 15, 11, 16, 21, 23, 20, 27; 463/1, 5, 40, 48

(56) References Cited

U.S. PATENT DOCUMENTS

| | | | | |
|---|---|---|---|---|
| 4,682,953 | | 7/1987 | Doerfel et al. | 434/16 |
| 4,695,058 | * | 9/1987 | Carter, III et al. | 434/16 |
| 4,744,761 | | 5/1988 | Doerfel et al. | 434/16 |
| 4,752,226 | * | 6/1988 | Akers et al. | 434/11 |
| 5,074,793 | * | 12/1991 | Hambric et al. | 434/11 |
| 5,207,579 | * | 5/1993 | Campagnuolo | 434/11 |
| 5,292,254 | | 3/1994 | Miller et al. | 434/11 |
| 5,382,958 | * | 1/1995 | FitzGerald | 434/16 |
| 5,474,452 | * | 12/1995 | Campagnuolo | 434/11 |
| 5,518,401 | | 5/1996 | FitzGerald et al. | 434/11 |
| 5,556,281 | | 9/1996 | FitzGerald et al. | 434/16 |
| 5,571,018 | | 11/1996 | FitzGerald | 434/16 |
| 5,690,491 | * | 11/1997 | Fitzgerald et al. | 434/11 |
| 5,695,341 | * | 12/1997 | FitzGerald | 434/11 |
| 5,781,437 | * | 7/1998 | Wiemer et al. | 434/11 |
| 5,941,708 | * | 8/1999 | FitzGerald | 434/11 |

FOREIGN PATENT DOCUMENTS

| | | | |
|---|---|---|---|
| 0809083 | 11/1997 | (EP) | 3/26 |
| 2176271 | 12/1986 | (GB) . | |

* cited by examiner

*Primary Examiner*—Mark Sager
*Assistant Examiner*—John M Hotaling, II
(74) *Attorney, Agent, or Firm*—Michael H. Jester

(57) ABSTRACT

An area weapons effect simulation system and method that determine the extent of simulated injuries and damage sustained by players such as soldiers and vehicles as a consequence of simulated mines, projectiles, air defenses, and toxic or nuclear clouds in near real time. The system uses a distributed architecture that simulates the effect that area weapons would have on each player in real time or near real time, thus allowing players to determine the consequences of their tactics and actions as a part of a combat training exercise. Player Units are pre-loaded with information which allows them to determine the probability of damage or injury, depending on the type of player, defensive measures taken on the part of the player, and the type of weapon being simulated. Alternatively, such information may be down-loaded to each Player Unit as necessary.

16 Claims, 7 Drawing Sheets

AREA WEAPONS EFFECT SIMULATION SYSTEM AND METHOD

BACKGROUND OF THE INVENTION

1. Field of the Invention

This invention relates to a system for realistically simulating the effects of area weapons on a battle field, and more particularly, to simulating the effect of area weapons on ground troops, vehicles, aircraft, equipment, structures, and weapons in a simulated battle field during combat training exercises.

2. Description of Related Art

The ability of a training system to effectively induce and maintain operational readiness in an army combat force is proportional to the ability of the system to generate training exercises which simulate an accurate, realistic combat environment that reinforces doctrine and applies penalties and rewards appropriate to the behavior of commanders, staffs, and individual soldiers. To generate training exercises which simulate an accurate, realistic combat environment, it is important to simulate the effects of area weapons on individual soldiers, vehicles, aircraft, equipment, structures, and weapons at a time which is as close as possible to the time that such effects would occur in an actual combat situation. Therefore, the effects imposed on participants in a training exercise should not be randomly applied and/or delayed in time from the precipitating actions of commanders and combat troops.

Distributed instrumentation systems have been used in the past to realistically simulate the effects of area weapons on a battlefield in order to assist in the warfare training of soldiers, including airmen, marines, sailors, army infantry soldiers, etc. in techniques that are necessary for conducting successful military operations. One such system determines the effects of a simulated minefield on troops and equipment that are moving through the simulated minefield. The position of troops and equipment (commonly referred to collectively as "players") is determined by affixing a "player detection device" (PDD) to each player. Alternatively, the location of players can be determined by a central computer. In addition, the location of each of a plurality of mines is known by either the player unit or the central computer. A military training exercise can then be initiated. The position of each of the simulated mines in the exercise must be identical for each of the players. The locations of the mines are determined by a bitmap. The location of the players and the location of the simulated mines are continuously compared, either in the player unit or in the central computer, in order to determine whether a player has detonated any of the simulated mines. Once a simulated mine has been detonated, that mine must be removed from the bitmap of simulated mines within the simulated minefield.

Accordingly, either the players must continuously communicate their position to the central computer, or the central computer must communicate the location of each of the mines within the simulated minefield to each of the players and update the minefield bit map at relatively frequent regular intervals. Whether the location of the mines is being transmitted to the PDDs or the locations of the players is being communicated to the central computer, a relatively large amount of information must be communicated between the central computer and the plurality of players involved in the exercise. Transmitting the massive amounts of information results in a high probability that incomplete or erroneous information will be received.

In addition, the currently available battlefield simulation systems do not have the ability to simulate air defenses, delivery of projectiles, and toxic or nuclear clouds. Accordingly, it would be desirable to provide a system that can simulate minefields, air defenses, delivery of projectiles, and toxic or nuclear clouds, all without the need to transmit excessive amounts of information between player units and a central computer.

SUMMARY OF THE INVENTION

The present invention provides an area weapons effect simulation system and method that allow players to determine the extent of simulated injuries and damage sustained as a consequence of simulated mines, projectiles, air defenses, and toxic or nuclear clouds in or near real time.

The system of the present invention uses a distributed architecture that simulates the effect that area weapons would have on that player in real time, and thus allows players to determine the consequence of their actions as a part of a combat training exercise. Each player is assigned a Player Unit which the player carries or which is affixed to the player. Each Player Unit is pre-loaded with information and tables which allow the Player Unit to determine the probability of damage or injury, depending on the type of player, defensive measures taken on the part of the player, and the type of weapon being simulated. Alternatively, such information may be down loaded to the Player Unit as necessary.

Player Units are designed to receive information locating points along the perimeter of an area in which the effects of a particular weapon would be felt (i.e., an "affected area") if an actual weapon were being used. Player Units track the location of the assigned player. Once a player enters an affected area, the Player Unit determines the probability that the player will be affected by the weapon. The Player Unit preferably performs a probabilistic function through a data table look-up process to assess his casualty status. The casualty status of the player is selected from a number of various possibilities associated with each type of player, the defensive measures that player has taken, and the weapon being directed into the affected area. The casualty status includes a near miss, a hit by a weapon resulting in a particular type of damage or injury, contamination by chemical or biological weapon, or dead/destroyed. In accordance with one embodiment of the present invention, each Player Unit includes all of the information required to determine the effects of a weapon upon a player. Players that are inside a vehicle that has been affected by a weapon are immediately alerted to the status of the vehicle and their own status by audible tones, stored voice messages, displayed text, or a combination of such cues.

The nature of the injury may be determined by the Player Unit. The severity of the injury is then modified as a function of the amount of time which elapses between the injury occurring and the player receiving proper medical attention. Players may carry a conventional casualty card. Once the Player Unit has determined that the status of the associated player has changed (i.e., the player has been injured or damaged), the Player Unit reports the change to the central computer.

The probability that a player will sustain injury or damage as a result of entering an affected area can be altered by one or more of the following factors. Players may be observed by a training administrator. The training administrator has the ability to vary the probability that a player will be injured or damaged (i.e., the players "injury probability") when the player enters an affected area. The training administrator may communicate with the Player Unit by radio conmmunication, or by firing a simulated weapon at the player, the simulated weapon having a message encoded within the beam that is transmitted to the Player Unit associated with the player whose injury probability is to be altered.

In accordance with another embodiment, a player may be designated as a commander. In response to the player being designated as a commander, the probability that the player will be injured may be altered from that of other players in the same situation. The probability of injury or damage may be either increased or decreased as a result of the player being designated as a commander, depending upon the objectives of the current training exercise.

In accordance with yet another embodiment of the present invention, the injury probability associated with a particular player may be dependent upon the location of the player and the terrain. Therefore, if a player is determined to be located in a depression in the ground (such as a foxhole or naturally occurring depression), the injury probability is reduced. In accordance with another embodiment of the present invention, this is accomplished by loading the Player Units with a relief map which indicates the nature of the terrain at each location to which the player may travel. Alternatively, an observer or training administrator may be responsible for altering the probability in players as a function of terrain. In yet another embodiment of the present invention, the central computer is loaded with a relief map of the terrain and modifies the probabilities used by the Player Units.

In accordance with another embodiment of the present invention, the fact that a player is upright or prone affects the probability of the player sustaining injury. Also, if the player is using proper tactics for avoiding injury, such as being under cover or dug in, then the injury probability is reduced. These factors may be determined by sensors on the player or in the Player Unit. Alternatively, these factors are determined by an observer.

In addition to determining the effect of a simulated weapon system on a player who directly encounters a weapon (i.e., who is responsible for activating the mine or who has been designated as being hit by a mortar shell, etc.), the present invention determines the effect of weapons on collateral players, structures, and equipment (i.e., those players who are in relatively close proximity to a player that has been directly affected). This is accomplished by the affected player communicating to the central computer that the weapon has affected that player.

In accordance with another embodiment of the present invention, when simulating projectile attacks, Player Units are placed on structures and equipment that may be affected by the projectiles. Accordingly, bridges, buildings and other such structures can be damaged or eliminated by incoming projectiles rendering such structures, etc. unusable or causing impediments to players.

Another embodiment of the present invention provides for "suppressing" players ability to fire weapons in response to a projectile striking within a predetermined distance of the player in order to simulate the response that has been noted under actual battle conditions. Therefore, when a projectile strikes, as determined by a first Player Unit, the first Player Unit communicates with the central computer. The central computer then responds by sending a message to all Player Units within a predetermined radius of the first Player Unit to cause those Player Units with the predetermined radius to disable the assigned players' weapons.

In accordance with another embodiment of the present invention, air defense weapons systems are simulated by determining a "dome of fire". When an airborne player enters the dome of fire associated with a particular weapon, the Player Unit assigned with the player determines the probability that the player will be affected by the air defense weapons system.

In accordance with another embodiment of the present invention, delays are created between the time that a Player Unit attempts to determine whether the player has been affected by the air defense weapons system, and the next time that the Player Unit determines whether the player is affected by that same air defense weapons system. Such delays simulate the time required to reload the particular weapon that is directed at the player in question.

The system of the present invention can also simulate toxic and nuclear clouds and the movement of such clouds The initial coordinates of the toxic or nuclear cloud are transmitted to each Player Unit. Each Player Unit then calculates the movement of the cloud by recalculating the coordinates of the perimeter of the cloud. Alternatively, the central computer recalculates and retransmits the coordinates of the perimeter of the cloud at regular intervals. Player Units determine the injury probability as a function of the type of cloud. In addition, the injury probability will be further determined as a function of the precautions taken on the part of the player.

BRIEF DESCRIPTION OF THE DRAWINGS

The objects, advantages, and features of this invention will become readily apparent in view of the following description, when read in conjunction with the accompanying drawings, in which.

Like reference numbers and designations in the various drawing figures refer to like elements.

DESCRIPTION OF THE PREFERRED EMBODIMENTS

Throughout this description, the preferred embodiments should be considered as exemplars, rather than limitations on the scope of the present invention.

Overview

The preferred embodiment of the present invention is a method and apparatus used in military training exercises to simulate the effects of area weapon systems. Area weapons are defined as weapons that are associated with a particular area within which injury or damage will occur to players as a consequence of the associated area weapon. Accordingly, area weapons include, but are not limited to, minefields, projectiles, bombs, toxic gas clouds, nuclear clouds, biological weapons, and air defense systems. However, it should be understood that many other weapons and dangers can be modeled in the same manner. Accordingly, the present invention can be applied to other weapons and conditions, such as explosive traps, etc.

Generalized Operation of the Present Invention

In accordance with one embodiment of the present invention, an AWES system preferably includes at least three components. The first component is a central computer 101 (FIG. 2) located at a central control center. The second component is one or more Player Units 105, each assigned to a particular participant in a military exercise or with a structure or device used in the exercise (i.e., a "player"). It should be understood that inanimate objects are referred to as players in this description. The third component is a communications link such as a regional control/relay station 103 between the central computer 101 and the Player Units 105. Each of these components will be described in detail below.

Figure 1A:
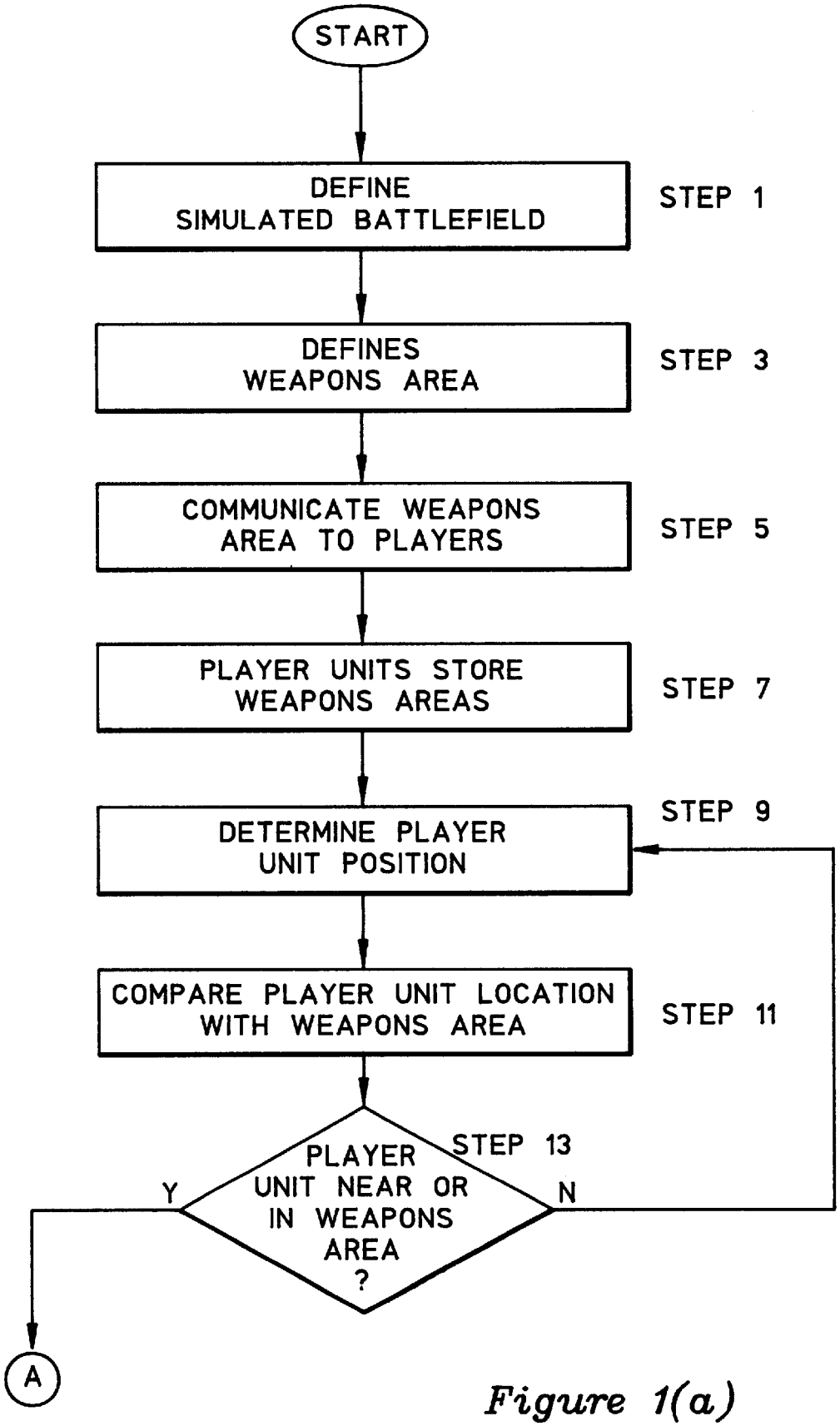
FIGS. 1(*a*), 1(*b*), 1(*c*) and 1(*d*) collectively comprise a flowchart of the generalized operation of an area weapon effects simulator (AWES) in accordance with a preferred embodiment of the present invention.
Figure 1B:
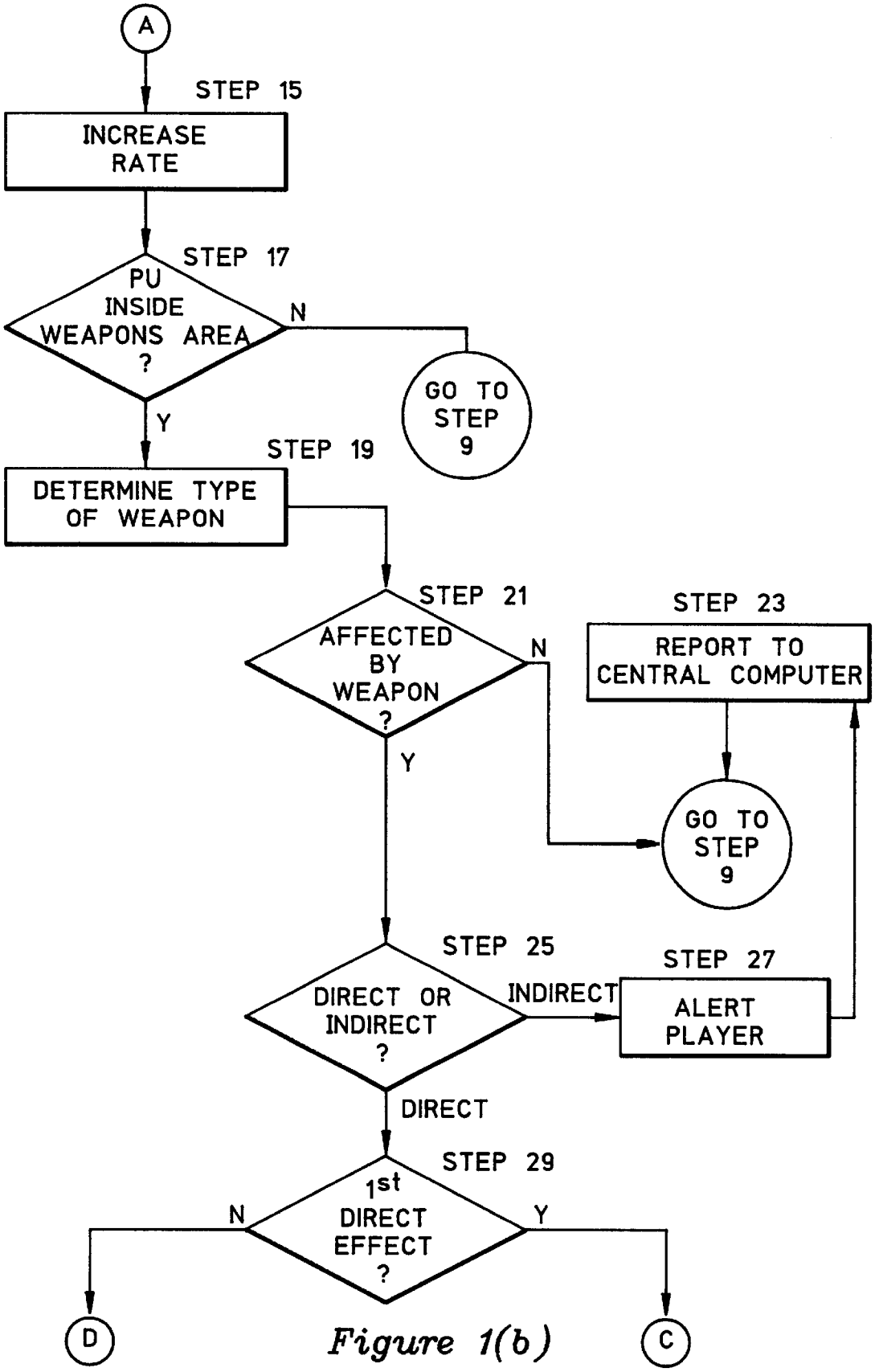
Figure 1C:
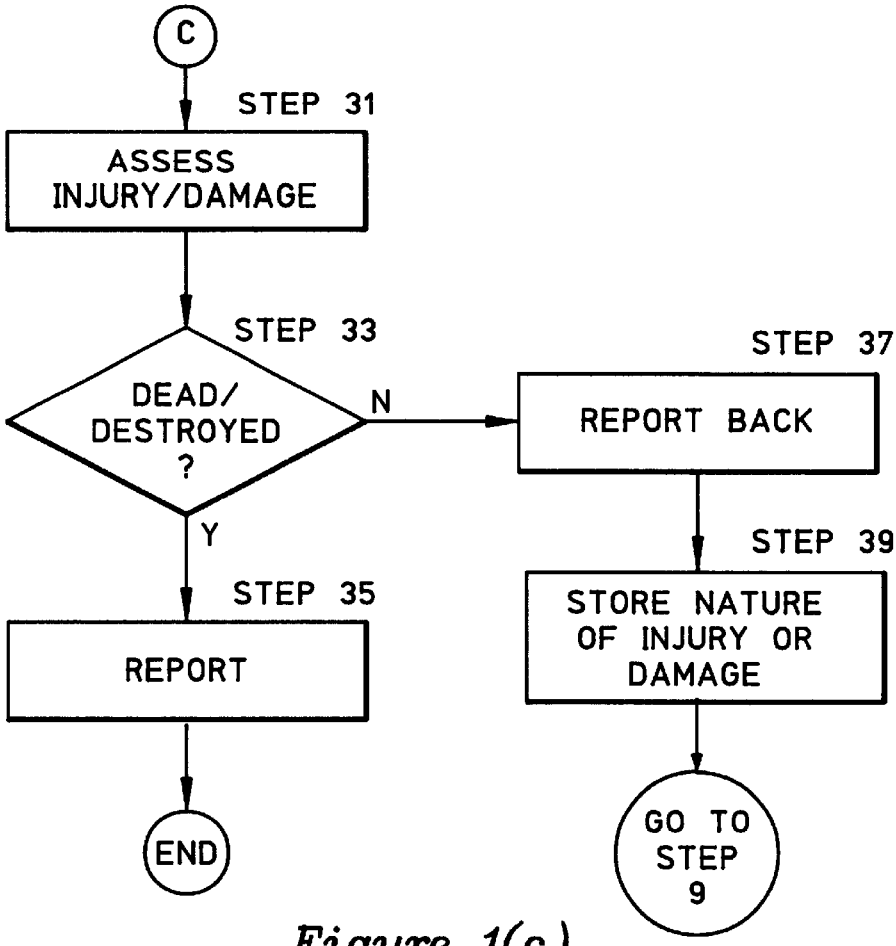
Figure 1D:
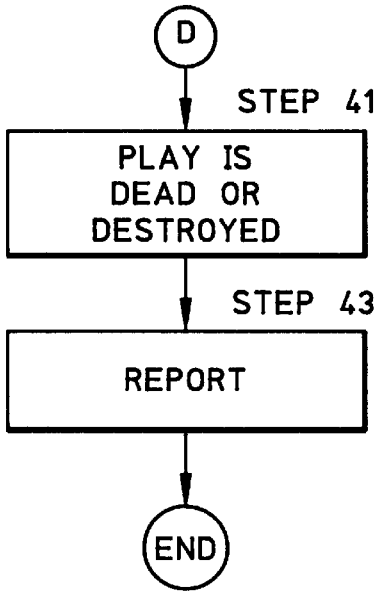
Figure 2:
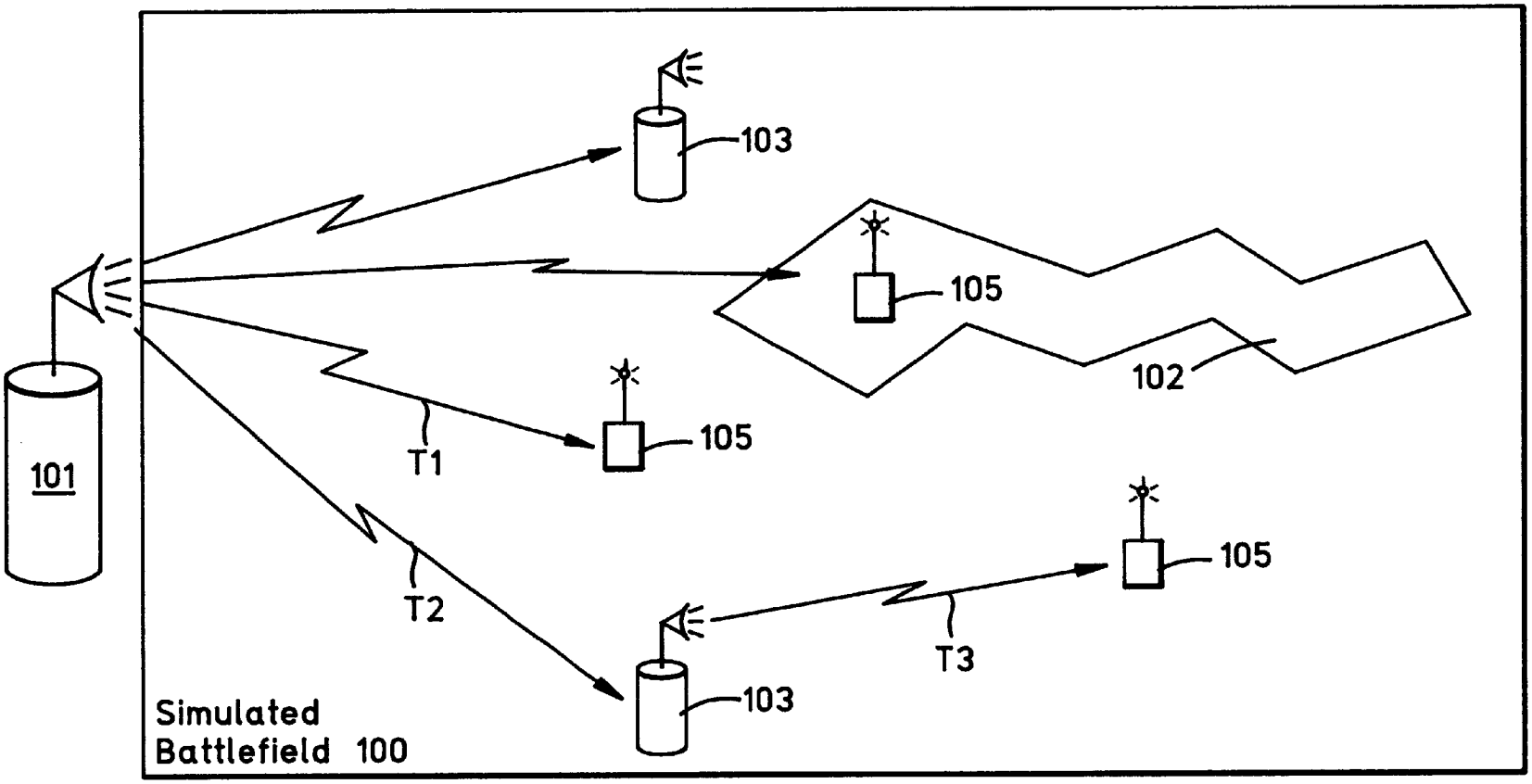
FIG. 2 is an illustration of the basic components of the preferred embodiment of the AWES of the present invention.

FIGS. 1(*a*), 1(*b*), 1(*c*) and 1(*d*) collectively comprise a flowchart of the generalized operation of an area weapon effects simulator (AWES) in accordance with a preferred embodiment of the present invention. The steps that are illustrated in these figures represent the most basic steps that are common to the present invention regardless of the type of area weapon being simulated and the type of player being affected by the weapon. The abbreviation PU is sometimes used instead of Player Unit. FIG. 2 is an illustration of the basic components of an AWES system in accordance with a preferred embodiment of the present invention. Referring to FIGS. 1, 1(*a*), 1(*b*), 1(*c*), 1(*d*) and 2, initially, a simulated battlefield is defined for the system as a fixed area. Initially, the simulated battlefield 100 is defined by the ability of the central computer to communicate effectively with Player Units (STEP 1). Accordingly, the simulated battlefield 100 is defined to include that area within which a remote device can be contacted by the central computer 101 and can respond to the central computer (i.e., an area within which two-way communication can be established between a remote device and a control station). Alternatively, the simulated battlefield 100 can be defined as some sub-portion of the total area within which a remote device can maintain two-way communication with the central computer 101.

After defining the simulated battlefield 100, one or more weapons areas 102 are defined at the central computer 101 or regional control/relay stations 103 (STEP 3). The manner in which a weapons area 102 is defined will be discussed in detail below. The weapons areas 102 are communicated to the Player Units 105 by either the central computer 101 or the regional control/relay stations 103 (STEP 5). Regional control/relay stations 103 are optional and the use of such stations 103 depends upon the cost of providing such stations verses the increased ability to effectively communicate and coordinate control functions throughout the system.

Figure 3:
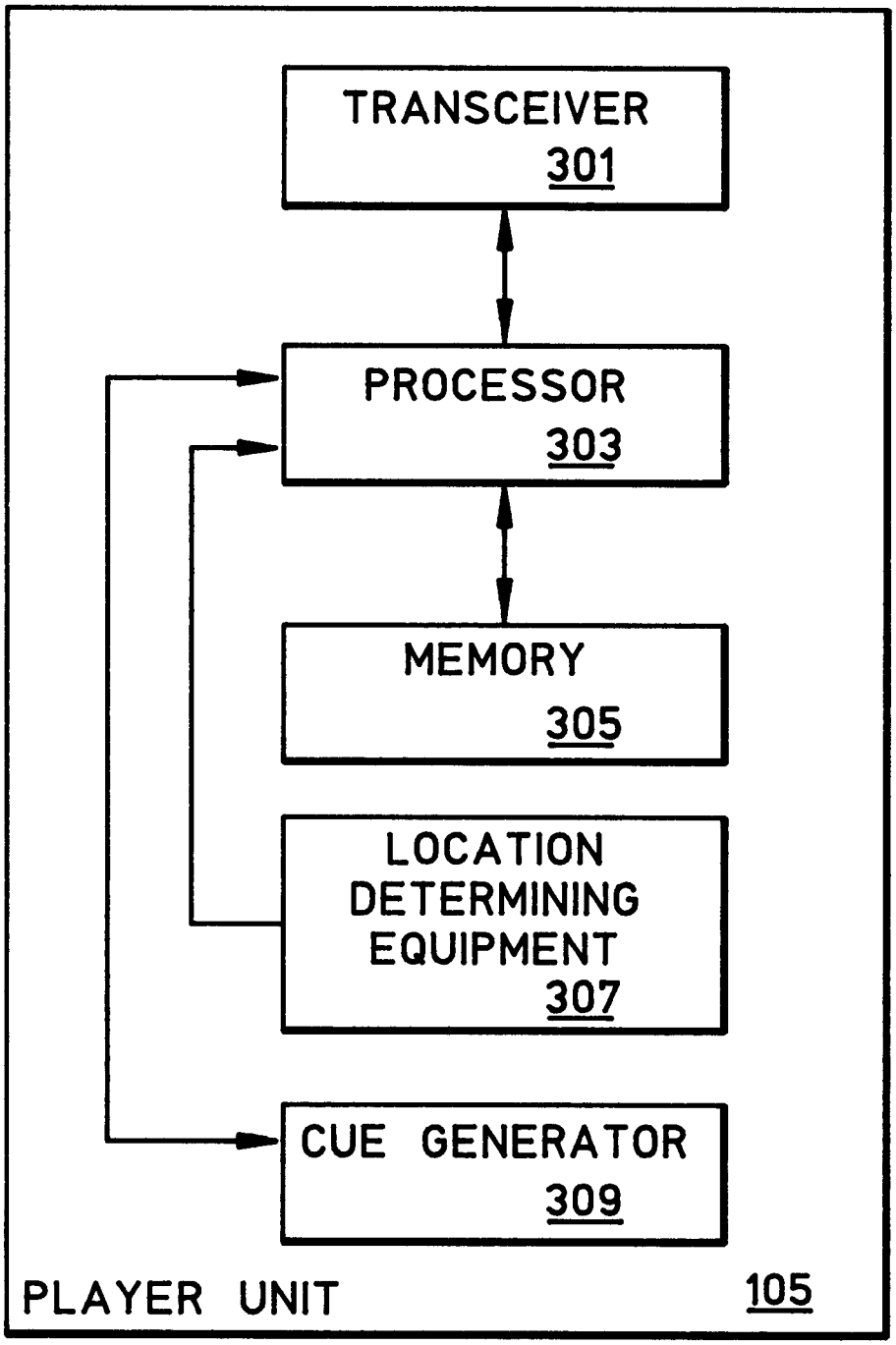
FIG. 3 is a simplified block diagram of a Player Unit in accordance with the preferred embodiment of the present invention.

When a Player Unit 105 receives information defining the location of a weapons area 102, the Player Unit 105 stores this information in its own local memory FIG. 3 is a simplified block diagram of a Player Unit 105 in accordance with the preferred embodiment of the present invention. The Player Unit 105 includes a transceiver 301 for transmitting information to, and receiving information from, other components of the AWES, such as the central computer 101 and the regional control/relay stations 103. In accordance with the present invention, the transceiver 301 is a conventional wireless communications device. However, it should be understood that other communications devices may be used. For example, where a Player Unit 105 is assigned to a stationary structure, such as a bridge or building, the Player Unit may communicate with other components of the AWES over wire lines (not illustrated). Furthermore, communications may be established by an optical communications system, sonic communications system (not illustrated) or any other communications system that allows the necessary information to be communicated between the Player Unit 105 and other components of the AWES. The transceiver 301 is coupled to a processor 303 that interprets the received information and processes information to be transmitted. The processor 303 is coupled to a memory 305. The memory 305 stores (STEP 7) definitions of weapons areas received from the central computer 101 and/or regional control/relay stations 103, and provides general memory for the processor's other functions. By way of example, the processor 303 may comprise a single chip computer and the memory 305 may comprise RAM, ROM and/or EPROM.

In addition, the Player Unit 105 (FIG. 3) includes location determination equipment 307 coupled to the processor 303 which allows the Player Unit 105 to determine the location of the Player Unit 105 (STEP 9). The processor 303 requests the location determining equipment to determine the location of the Player Unit 105 at regular intervals. In accordance with the preferred embodiment of the present invention, the length of the intervals depends upon the type of player to which the Player Unit 105 is assigned and the last location of the Player Unit 105. For example, if the Player Unit 105 is assigned to a dismounted soldier (i.e., a soldier on foot), then the processor 303 requests an update to the location of the Player Unit 105 at ten-second intervals. The interval may be decreased to one second if the Player Unit 105 is within a predetermined area surrounding a weapons area 102 or inside the weapons area 102.

Alternatively, if the Player Unit 105 is assigned to a stationary structure, such as a bridge, then the location of the Player Unit 105 need only be determined at the beginning of the simulation exercise or upon an indication that the Player Unit 105 is to be reassigned to another player. However, in an alternative embodiment, Player Units assigned to stationary players determine the player's position at regular intervals. By way of example, the location determining equipment 307 may comprise a commercially available Global Positioning Satellite (GPS) receiver.

The Player Unit 105 (FIG. 3) includes a cue generator 309 which is preferably capable of providing audio cues to the assigned player. The cue generator 309 may also provide cues to other nearby players. Verbal or other audio cues may also be generated to provide players with necessary information. In addition to audio cues, the cue generator 309 may also provide visual and tactile cues in the form of flashing lights, displayed text, and vibrations which can be felt by the player to which the Player Unit 105 is assigned. By way of example, the cue generator 309 may include a liquid crystal display (LCD). The Player Unit 105 includes a source of power such as a battery (not illustrated) for its components.

The processor 303 within the Player Unit 105 compares the location of the Player Unit 105 with the perimeter or boundaries of the weapons areas 102 stored in the memory 305 (STEP 11) to determine whether the Player Unit 105 is near or inside any of the defined weapons areas 102 (STEP 13). If the Player Unit 105 is inside or within a predetermined distance of a weapons area 102, then the rate at which the location of the Player Unit 105 is determined is increased (assuming that the rate is not already at the maximum rate) (STEP 15). Next, the processor 303 determines whether the Player Unit 105 is inside a weapons area 102 (STEP 17), and not just near or inside a weapons area 102. If the Player Unit 105 is inside a weapons area 102, then the Player Unit 105 determines the type of weapon associated with the weapons area 102 in which the Player Unit 105 is currently located (STEP 19). Each weapons area 102 is associated with a particular type of weapon. The type of weapon associated with the weapons area 102 is preferably stored in the memory 305 together with the definition of the weapons area. Associated with each type of weapon is information that indicates the probability that a particular type of player will be affected by the weapon as a consequence of entering the associated weapons area 102. In addition, the type of injury or damage that can occur as a consequence of the weapon is also stored in the Player Unit 105 in association with the definition of the weapons area 102. Still further, information regarding how damage will be mitigate, in response to defensive measures and equipment used by the player is preferably associated with the definition of the weapons area 102.

Once the type of weapon associated with the weapons area 102 is established, a determination is made as to whether the player has been affected by the weapon (STEP 21). The determination as to whether a player has been affected by a weapon as a consequence of entering a weapons area 102 is made based upon the probability that the player would be affected in a real battle situation. This may be accomplished using a random number generator to arrive at an outcome defined by well-known statistical algorithms.

If the processor 303 determines that the player has not been affected by the weapon, then, depending upon the type of weapon at issue, this information is reported back to the central computer 101 (STEP 23). For example, if the weapon at issue is a minefield, then the fact that the player has entered the minefield without effect is used to determine the current status of the minefield. More particularly, the central computer 101 removes locations which have been successfully traversed by at least one player from the minefield to simulate that the area traversed by the player is free of mines. Alternatively, depending upon the type of land mines used in the simulated minefield, the central computer 101 may increase the likelihood that the next player to traverse that portion of the minefield will be affected by a mine, thus simulating multi-trigger mines which require more than one triggering event before they are detonated. The particular manner in which the central computer 101 reacts to the information reported by the Player Unit 105 is discussed in more detail below. Upon reporting in STEP 23, the process repeats from STEP 9.

If the processor 303 determines that the player has been affected by the weapon (STEP 21), then the processor 303 preferably determines whether the effect is due to a direct or indirect effect (i.e., a hit or a near miss for most weapons) (STEP 25). If the processor 303 determines that weapon has missed the player, then the player is alerted by the cue generator 309 (STEP 27). The Player Unit 105 then reports to the central computer 101 (STEP 23).

If the processor 303 determines that the player has been directly affected by the weapon (STEP 25), then the processor 303 determines whether this is the first direct effect sustained by the player (STEP 29). If this is the first direct effect, then the extent of injury or amount of damage is assessed (STEP 31). If the player is determined to be dead or destroyed (STEP 33), then the processor 303 reports this condition to the central computer 101 and logs out (i.e., is removed from the exercise) (STEP 35). However, if the player has only been injured or damaged (STEP 33), then the processor 303 reports back this condition (STEP 37), stores the players condition, i.e. nature of injury or damage (STEP 39), and the process continues from STEP 9.

Returning to STEP 29, if the player has been directly affected by a weapon more than once, then the player is considered to have been killed or destroyed (STEP 41). The Player Unit 105 then reports this condition to the central computer 101 (STEP 43) and logs out, thus ending the simulation for that player. In accordance with an alternative embodiment of the present invention, the cumulative effect of multiple direct effects can be summed to a level of damage or injury that is less than total death or destruction of the assigned player. In such a case, the processor 303 assesses the damage or injury and reports back (STEP 37). The nature of the injury or damage is stored in order to facilitate further assessments upon additional direct effects being sustained by the player (STEP 39), and the process continues from STEP 9.

It should be understood that the Player Unit 105 may be inside more than one weapons area 102 at one time. Therefore, such an analysis must be performed in association with each weapons area 102 in which the player is located.

General Information Regarding the Central Computer

Figure 4:
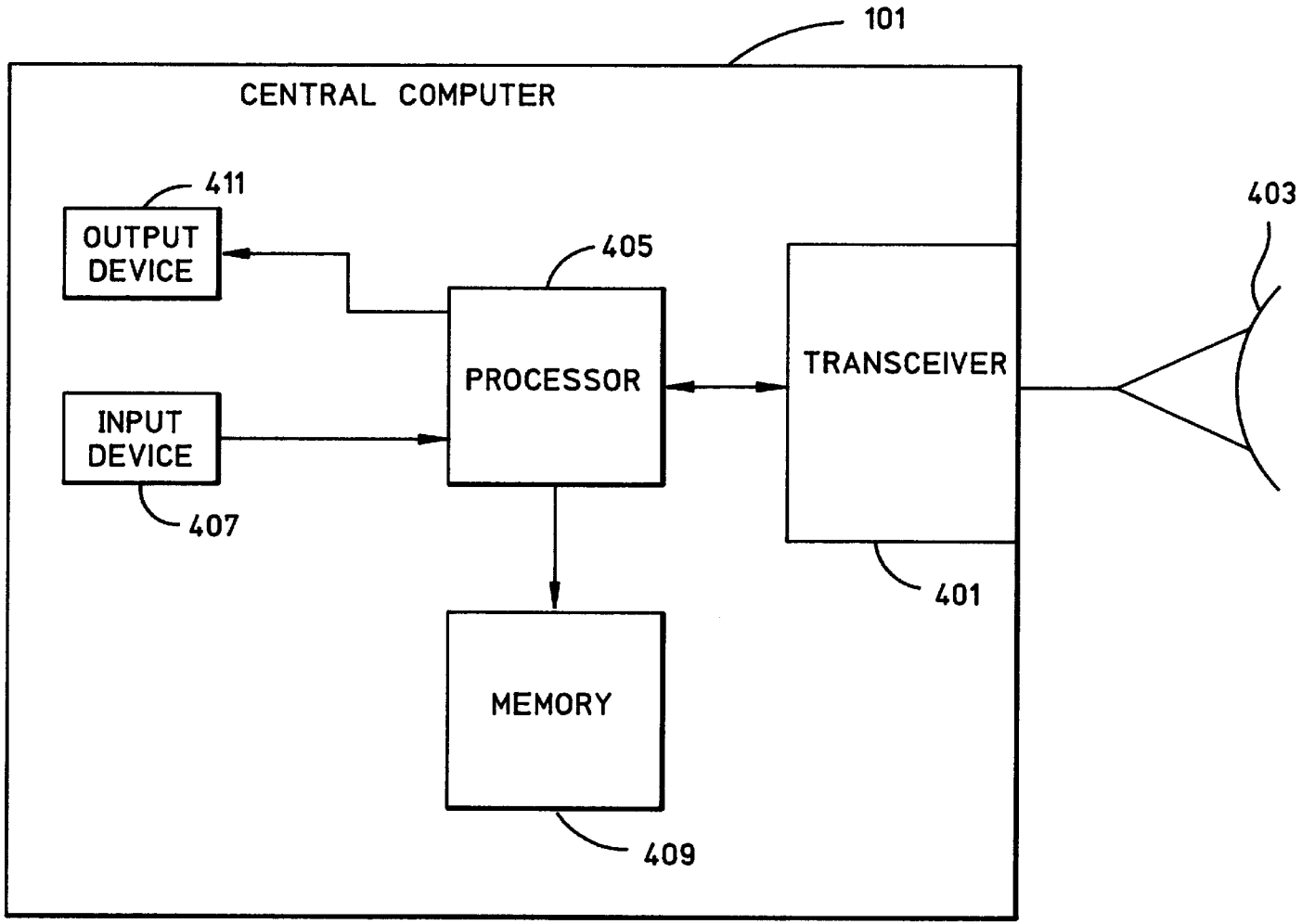
FIG. 4 is a simplified block diagram of the central computer in accordance with the preferred embodiment of the present invention.

FIG. 4 is a simplified block diagram of the central computer 101 in accordance with the preferred embodiment of the present invention. As illustrated in FIG. 4, the central computer 101 has a transceiver 401 coupled to an antenna 403 for transmitting and receiving information. In an alternative embodiment of the present invention, the central computer may also transmit and receive information over wire lines which interface with the public telephone system by modems, or otherwise transmit information over the air or through a directed medium, such as wire, optical fiber, waveguide, or any other such medium. The transceiver 401 is coupled to a processor 405. The processor 405 may be any general purpose programmable device, dedicated circuit, such as a state machine, circuit comprised of discrete components, or application specific integrated circuit. The transceiver 401 and processor 405 are connected to a source of power (not illustrated) such as a portable generator. The processor 405 is preferably coupled to a user input device 407 which allows a user to enter information that defines the weapons area 102. The definition of the weapons area is stored in a memory 409 which is coupled to the processor 405. The input device is a keyboard, touch screen, mouse, microphone, array of buttons, disk drive, tape drive or any other means by which a user can enter information regarding the relative location of a weapons area and the type of weapon to be associated with the weapons area. In accordance with the preferred embodiment of the present invention, more than one such weapons area 102 can be defined and stored within the memory In accordance with the preferred embodiment of the present invention, the input device 407 allows the user to define the location of a weapons area by selecting points on the periphery of the weapons area. The order in which these points are entered by the user determines the manner in which the points are connected in order to define a closed area. Therefore, in accordance with one embodiment of the present invention, the user defines the weapons area by touching points on a touch screen, entering numeric values on a keyboard, "clicking" a mouse at locations on a video display, speaking into a microphone to identify the points using cartesian coordinates, or any of a wide variety of other means for identifying the location of points within the simulated battlefield 100. Alternatively, the location of the weapons area may be defined by the user using other techniques, such as by identifying a center and radius or diameter, selecting a shape from a menu of shapes and locating the shape with respect to a map of the simulated battlefield 100, or by any other method for defining the location, size, and shape of the weapons area.

Various techniques may be implemented to ensure that the user enters valid points. For example, if the user attempts to enter points which would cause the lines which define the perimeter of the weapons area to cross, then an output device 411 indicates an error in the entry. The output device may be any means for communicating information to the user, such as a video display, an audio speaker, lights, alpha-numeric display elements, etc.

Once the weapons area 102 is defined, the processor 405 (FIG. 4) identifies points on the perimeter of the weapons area 102 that can be used to define the location of the boundaries of the weapons area 102 within the simulated battlefield 100. The points are transmitted to the Player Units 105 in sequential order. Thus, a line coincident with the perimeter of the weapons area 102 exists between each point and the point which is transmitted immediate before and immediately after. In addition, a line coincident with the perimeter exists between the first point transmitted and the last point transmitted. In this embodiment, some means, such as an end code, must be transmitted to identify which point was transmitted last. In accordance with the preferred embodiment, the first point is retransmitted at the end. By retransmitting the first point as the last point, the Player Units will know when the weapons area definition is complete. In an alternative embodiment of the present invention, the location and shape of the weapons area 102 can be transmitted as a series of shapes, the location of each shape being determined by transmitting the location of one or more points of the shape and the critical dimensions of the shape. For example, the weapons area associated with a bomb can be defined as a circle with a center at a particular location and having a radius of a particular length. A minefield may be defined as a combination of overlapping shapes, such as a series of rectangles each having length "l", width "w", a rotation angle of "θ" and having a southern most corner located at a particular point. If more than one corner lie on the same longitude, then the location of the southern most point that lies farthest to the west is provided. By defining the weapons area 102 in this way, the amount of information that must be transmitted between the central computer 101 and the Player Units 105 is significantly reduced. Since there are likely to be a relatively large number of weapons areas within any one battlefield, each needing to be broadcast to the Player Units 105 at regular intervals, it is important to limit the amount of information that is required to fully define each such weapons area 102.

Figure 5:
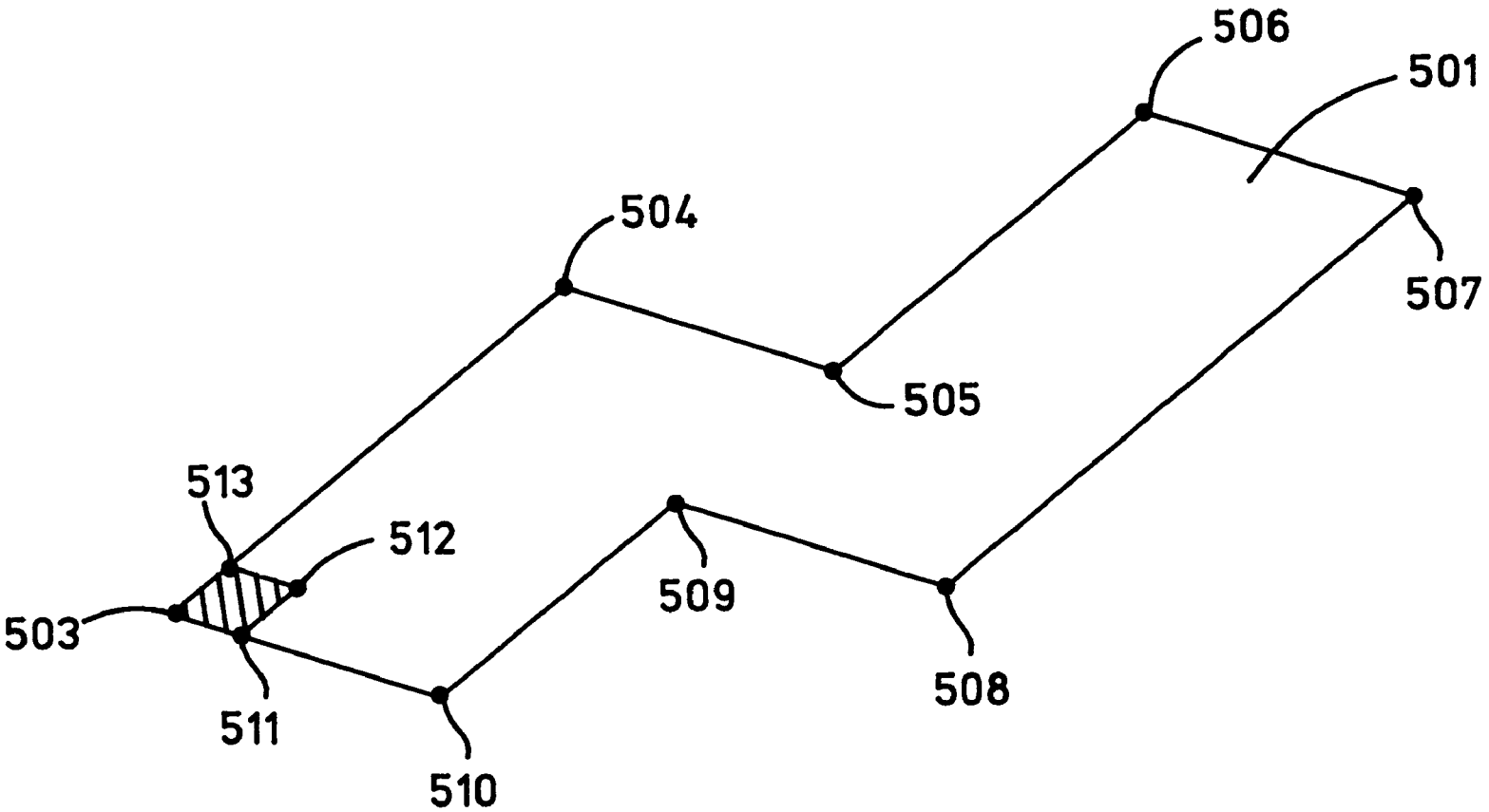
FIG. 5 is an illustration of a pre-existing weapons area which has been stored in the memory of each of the Player Units as a list of points connected by lines which form the perimeter of a minefield.

Once a weapons area 102 has been defined and transmitted to the Player Units 105, the size and shape of the weapons area 102 can be modified by either broadcasting a message to the Player Units 105 to delete the weapons area from the memory within each Player Unit 105, or by broadcasting a change request in the form of a new area collocated within an existing weapons area 102 which removes the new area from the preexisting definition. For example, FIG. 5 is an illustration of a preexisting weapons area 501 stored in the memory 305 of each of the Player Units 105 as a list of points 503–510 connected by lines which form the perimeter of the weapons area 501 representing a minefield. In order to alter the minefield to represent that a portion of the minefield has been cleared, a change request is broadcast to each Player Unit 105 including the location of the four points 503, 511, 512, and 513. In response, each of the Player Units 105 changes the definition of the weapons area 501 to indicate that the perimeter now is defined by the points 504–513, thus removing the portion outlined by the points 503, 511, 512, and 513.

General Information Regarding the Communication Link

The communication link 103 between the central computer 101 and the Player Units 105 of the present invention can be structured in a variety of ways. This link may include a plurality of the control/relay stations 103 each having its own source of power (not illustrated) such as a battery or portable generator. In accordance with the preferred embodiment of the present invention illustrated in FIG. 2, the central computer 101 communicates either directly with Player Units 105, as indicated by the line T1 or through a regional control/relay station 103, as indicated by lines T2 and T3. The need for regional control/relay stations 103 is primarily a function of the ability of the central computer 101 to establish a reliable two-way communications link with each and every Player Unit 105. This is not always possible by direct transmission from the central computer 101, since the terrain of the simulated battlefield 100 may be such that Player Units 105 will "disappear" behind hills, mountains, buildings, etc. Furthermore, it may be more cost effective to provide relatively low power transmissions from the central computer 101 which are incapable of reaching across the entire simulated battlefield 100. Still further, due to power limitations in the Player Units 105 and restrictions on the size and type of antennas that can be used in the Player Units 105, even if communications can be established between the central computer 101 and the Player Unit 105, the Player Unit 105 may not be able to transmit with sufficient power to be reliably received by the central computer 101. Therefore, regional control/relay stations 103 may be used to assist in providing a reliable two-way communication link between the central computer 101 and the Player Units 105.

In addition, regional control/relay stations 103 may be used to off load some of the burden that would otherwise rest solely with the central computer 101. For example, the central computer 101 allows a user to define and manage all of the weapons areas 102. Since there may be a relatively large number of such weapons areas 102, this task may become burdensome for a single central computer. Thus, by off-loading the responsibility for retransmitting and maintaining some of the weapons areas 102 to regional control/relay stations 103, the amount of data processing and management that must be performed by the central computer 101 can be reduced to a more manageable level. In addition, if multilateration is used to determine the position of Player Units 105, the regional control/relay stations 103 can assist in the multilateration function. However, it should be noted that such regional control/relay stations 103 are not required, and a simulator in accordance with the present invention may be fully functional without such regional stations.

Communication between the central computer 101 and the Player Units 105 is preferably accomplished by a direct radio transmission. However, any alternative method for transmitting the information may be used, such as transmission of radio signals to a satellite relay station and then on to either regional control/relay stations 103, or directly to Player Units 105. Alternatively, other forms of energy can be used to transmit information, such as light or sound. Furthermore, while wireless communications appear to be far superior to the alternatives, it is not essential to the present invention that communications between the central computer 101 and the Player Units 105 be over a wireless link. In fact, for some Player Units which remain stationary or which move relatively little, direct, i.e. "hard wired" communication links may be more advantageous under conditions in which reliable radio transmissions may be difficult to establish. Information that is to be provided to all, or most, of the Player Units 105 is broadcast. Additional information that is directed to a relatively few Player Units 105 can be coded for only those Player Units 105 to which the information is intended. Such direct connections may be from the central computer 101 to the Player Units 105, or may be only from the central computer 101 to the regional control/relay stations 103, thus allowing the final leg of the communication link to remain wireless, but relatively short if a relatively large number of relay stations 103 are used.

General Operation of the Player Unit

The Player Unit 105 has four broadly defined functions. First, the Player Unit 105 must receive and store the location of each weapons area 102 which currently exists in the simulation. Second, the Player Unit 105 must determine the location of the player with respect to each of the weapons areas to identify when a player enters or approaches a weapons area 102. Third, the Player Unit 105 must determine the probability that a player will be affected by the weapons associated with a weapons area 102 when the player enters the weapons area 102. Fourth, the Player Unit 105 must determine the consequence to the player of entering the weapons area 102.

The manner in which the Player Unit 105 receives the definition of the weapons area 102 will now be described in further detail. The Player Unit 105 receives messages from the central computer 101 either directly or through a regional control/relay station 103. These messages are preferably broadcast to all Player units 105. Therefore, each player preferably operates under the same conditions. However, in an alternative embodiment of the present invention, different conditions can be established for different individuals or groups by directing messages to selected Player Units 105. The messages may be in any format that allows the necessary information to be transmitted between the central computer 101 and the Player Units 105. However, in the preferred embodiment of the present invention, the location of each weapons area 102 is provided to the Player Units 105 as a set of points that are connected one to another by lines which extend from point to point in the order that the points are received The first and last point are connected by a final line which closes the weapons area 102.

In addition to defining the location of each weapons area 102, the central computer 101 must indicate the type of weapon (or weapons) to be associated with each weapons area 102. More than one weapon can be associated with a particular weapons area 102. However, once received by the Player Unit 105, the Player Unit 105 must evaluate the effect of each weapon separately. For example, one weapons area 102 may be defined as being associated with both land mines and artillery. Accordingly, when a player enters this weapons area 102, the Player Unit 105 must determine the probability that the player will detonate a land mine, and independently determine the probability that the player will be hit by an artillery shell.

Once the Player Unit 105 has received the information necessary to determine the location and nature of each of the weapons areas 102, the Player Unit 105 checks the location of the assigned player (i.e., the location of the Player Unit) at predetermined intervals. These intervals are preferably of a first equal duration when the Player Unit 105 is not inside or near any weapons area 102 and of a second equal duration when the Player Unit 105 is inside or near any weapons area 102. The duration depends upon the type of player to which the Player Unit 105 has been assigned and whether the player is being transported by a vehicle, is on foot, or is stationary. In accordance with the preferred embodiment of the present invention, a Player Unit 105 assigned to a vehicle that is not inside or near a weapons area 102 checks location on approximately ten-second intervals and a Player Unit 105 assigned to a foot soldier checks location on approximately thirty-second intervals. When a Player Unit 105 approaches a weapons area 102, the intervals reduce to one second for Player Units 105 assigned to both foot soldiers and vehicles. Player Units 105 assigned to soldiers that are being transported by a vehicle preferably check location at the same intervals as the vehicle transporting the soldier.

In accordance with the preferred embodiment of the present invention, upon entering a weapons area 102, the Player Unit 105 determines the probability that the assigned player will be affected by a weapon based on statistical data derived from actual battle conditions and the conditions associated with the particular weapon being simulated. Such statistical data is preferably preloaded into the memory 305 of each Player Unit 105 in the form of a look-up table. For example, if a particular weapons area is designated by the central computer 101 to be a minefield 102, additional information is preferably provided to the Player Unit 105 to indicate the type of mines that are laid, the density of the minefield, the pattern of the mines, and other information that will be necessary to determine within the Player Unit 105 the probability that a player will be affected by the minefield. This information is used by the Player Unit 105 to select an entry from the look-up table. Alternatively, the probability may be calculated at the m central computer 101 and transmitted to the Player Unit 105 along with the definition of the weapons area 102 to be implemented by each Player Unit 105 in determining whether the player to which the Player Unit 105 has been assigned has been affected. The probability that a player has been affected by a weapon can be modified by intervention from an observer, particular actions taken by the player, or by equipment that the player has available for use in defending against the weapon. For example, if a training administrator observes a player proceeding in a reckless manner, the administrator may communicate with the Player Unit 105 assigned to that player or with the central computer 101 in order to increase the probability that the player will be affected by a weapon. Preferably, the administrator indicates in the communication the particular weapons for which this change in probability will occur in order to more realistically increase the danger to a particular player. The communication may be made through conventional radio transmission. Alternatively, the communication may be made by having the administrator fire a simulated weapon at a player. The simulated weapon modulates or otherwise encodes a transmission sent out from the simulated weapon. Additional details regarding the manner in which the probability is determined will be explained below.

The effects of at least some types of weapons may be delayed by a relatively short random amount of time in order to simulate the fact that shells fall over a period of time, and not all at one time. Therefore, when a group of players enter a particular weapons area 102, a certain number of Player Units 105 will have immediately determined that the players to which these Player Units are assigned have been affected by the weapon. However, the effects are not revealed to each of the affected players at the same time.

Once the Player Unit 105 determines the type of weapon and the probability that the player to which the Player Unit 105 has been assigned has been affected, the Player Unit 105 determines the extent of the effect on the player. The effect of the weapons on the player can range from a near miss to a fatal hit. The effect on the player is also preferably determined by a statistical method. Thus, the Player Unit 105 determines the extent of the effect of the weapon on the player. For example, if a player enters a minefield and is determined to have detonated a mine, the probability that the player will be killed versus the probability that the player will be non-fatally injured, and the particular manner in which the player will be injured is determined. The extent of the injury is then selected based upon these probabilities. If the player is not removed from the exercise by the injury, then the fact that the player has been affected is stored in the memory within the Player Unit 105 so that cumulative injury and damage can be calculated if the player is affected by another weapon at a later time. If the player has been affected by a near miss, the Player Unit 105 preferably reports this fact to the player through cues, such as sound effects and/or displayed text. The Player Unit 105 also reports this event to the central computer 101.

Simulation of Minefields

A minefield is entered into the central computer 101 by a user as a package of data. The minefield is described by its shape and location on the training area in either single or multiple squares or rectangles or a series of polygon coordinates which describe a complex shape. Alternatively, a minefield can be described by selecting a shape from a menu and manipulating the shape either graphically or mathematically. For example, the user may locate a shape on a map of the battlefield. The user may then select points on the periphery of the minefield using a pointing device, such as a mouse or light pen, and drag the selected points to new locations on the map to define the minefield as the user desires.

Minefield data also includes data describing a zone surrounding the minefield which activates Player Units 105 to enter into a more rapid location determination mode. The minefield is described by one or more mine types and programmable mine parameters, including delay times or target profile data. The overall density of mines within the minefield is represented by a density parameter for each type of mine used. The entered minefield is then given a status of active or inactive. A partial minefield, resulting from the minelaying team on the training area not completing their assigned minelaying action, can also be simulated by defining new minefield boundaries to describe a reduced minefield area. The minefield description data is preferably nonselectively broadcast to all of the Player Units 105. In order to conserve bandwidth or time, this data is broadcast only to selected groups of Player Units 105 which are likely to encounter the minefield. The broadcast data includes the active or inactive status of the minefield.

In accordance with the preferred embodiment of the present invention, a GPS having approximately +/−five meter accuracy is used as the location determination equipment 307 to determine the position of each of the Player Units 105. The Player Units 105 may be placed on soldiers, mine ploughs, tanks, troop carriers, or any other vehicle. Accordingly, the present invention preferably allows a simulated minefield to be cleared by the entry of a mine plough. That is, once a Player Unit 105 assigned to a mine plough enters a minefield, the Player Unit 105 reports back the fact that the plough has entered the minefield. As the plough breaches the minefield, the central computer 101 redefines the weapons area 102 to simulate the fact that the minefield has been cleared. The area over which the plough traverses can be either considered to be completely clear of mines, in which case the central computer 101 can amend the size and shape of the minefield weapons area 102 to exclude those portions of the weapons area over which the plough has traversed. In addition, the central computer 101 can define a new weapons area 102 which includes the area traversed by the plough. This new area can be defined to have a far lower density of mines, simulating the fact that some mines may remain in the area that the plough has traversed. The lower density causes the Player Units 105 to use a far lower probability of detonating a mine in determining whether players that enter this newly defined weapons area 102 will be affected by the weapon (i.e., any remaining mines).

Likewise, when other types of players enter a minefield, the Player Unit 105 assigned to the player reports back to the central computer 101 indicating those areas that are traversed. The central computer 101 then updates the weapons area 102 definition to indicate that the minefield has been breached. In the same manner as described above, this can result in an amendment to the definition of the minefield. In addition, such a breach of the minefield results in a new weapons area 102 being defined which includes the traversed areas of the minefield, but in which the probability of detonating a mine is reduced.

The present invention is intended to provide a realistic simulation of minefields. Therefore, additional information regarding the behavior of a player and equipment that the player may be utilizing may reduce the probability that a player will detonate a mine or may mitigate the injury that the player will sustain if a mine is detonated. For example, a player may be designated as a member of a minefield breaching team. Such members may determine the probability of detonating a mine at a lower probability than for other players, thus simulating the possibility that a mine will be detonated, but significantly reducing this possibility.

Furthermore, if a player enters a minefield in prone position and uses his bayonet to probe the ground in front of him before moving forward, that player is less likely to detonate a mine than another player who enters the minefield standing upright and does not probe the ground ahead before moving forward. In order to account for such variations in the probability that result from each of these two actions, the present invention allows an observer to identify behaviors that would reduce the probability that a player will detonate a mine. The observer may then report this behavior to the central computer 101, which updates the Player Unit 105 to cause the Player Unit 105 to use a lower probability that the player will be affected by the minefield. Some behaviors that alter the probability that the player to which the Player Unit 105 has been assigned will be affected by the weapon may be detected by instruments and/or sensors (not illustrated) within the Player Unit 105. For example, the fact that the player is in prone position, rather then upright may be detected by a sensor within the Player Unit 105. Alternatively, a sensor (not illustrated) may be worn by the player and connected to the Player Unit 105.

Mines may be simulated which require more than one triggering event to detonate. This is done by reporting to the central computer 101 when a Player Unit 105 determines that a player has been affected by the minefield. In response, the central computer 101 determines that that location has a mine which has been triggered once. Accordingly, the central computer 101 removes that location from the original minefield and generates a new weapons area 102 which includes that location and which has the characteristic that the third player to traverse that location will detonate a mine. This newly defined weapons area 102 is transmitted to all Player Units 105. When the next player traverses that location, the central computer updates the definition of the weapons area 102 to indicate that the next player to traverse that location will detonate a mine. When the third player traverses that location, that player has a very high probability of detonating the mine (nearly 100%) and must then determine the extent of the injury (or damage in the case of a vehicle or other equipment player).

When a player detonates a mine, the type of player may be considered to determine whether any collateral damage is to be assessed. For example, if a vehicle detonates a mine, fragments of the vehicle may be scattered and cause collateral damage or injury to near by personnel or equipment. Furthermore, secondary explosions may occur in equipment that has ordnance on board. Therefore, in the preferred embodiment of the present invention, when a Player Unit 105 determines that it has detonated a mine and reports to the central computer 101, the central computer assesses whether to contact other nearby Player Units 105 to determine whether such nearby Player Units 105 have been struck by flying debris or affected by secondary explosions. Each Player Unit 105 is preloaded with probability tables which allow the Player Unit 105 to determine collateral damage as a function of this preloaded probability when the central computer 101 indicates that the Player Unit 105 was in the vicinity of another player that has detonated a mine. In an alternative embodiment, when a vehicle Player Unit 105 determines that it has detonated a mine and reports to the central computer 101, the central computer defines a new, circular affected area of collateral damage surrounding the location of the vehicle Player Unit 105 and broadcasts this new area to either all or a selected group of Player Units 105. Each Player Unit 105 then evaluates whether it is within the collateral damage area and determines by probability if it has sustained a casualty. In still an alternative embodiment, Player Units 105 directly contact other nearby Player Units 105 to report that they have been hit and to allow the receiving Player Unit 105 to evaluate whether the player to which the receiving Player Unit is assigned has sustained collateral damage as a result of its proximity to the Player Unit 105 that has been hit.

It should be noted that the type of player to which the Player Unit 105 has been assigned will greatly affect the probability that the player will be damaged. For example, the probability that a foot soldier that detonates a mine will be injured is far greater than the probability that a tank will be damaged by the same type of mine. Accordingly, the probability that is used in each Player Unit 105 preferably takes into account the type of player to which that Player Unit 105 is assigned when entering the weapons area 102 as well as the type of weapon that is encountered. Furthermore, different types of mines and differing mine densities are preferably taken into account in determining the probability that a player will be affected by a mine when that player enters a minefield. Still further, when a player enters a minefield, the Player Unit 105 will only determine whether the player was affected by the mine once for each initial entry into a coordinate zone (i.e., an area which is approximately equal in size to the accuracy of the player location determining equipment being used). For example, if a GPS is being used as the location determining equipment 307 (FIG. 3) that has an accuracy of +/−five meters, then the minefield is divided by the Player Unit 105 into sub-areas of approximately ten meters in diameter. As a player traverses the minefield, the probability that the player has detonated a mine is made as the player enters each ten-meter sub-area of the minefield.

One of the benefits of the present invention is that a wide variety of mines can be simulated, each having different effects on the players that encounter the minefields and each having a different probability of being detonated by each particular type of player. The differences in the effects are taken into account in the present invention by altering the manner in which, and probability that, a player will detonate a mine and by altering the probability and types of injury and damage that will result as a consequence of detonating a mine.

Simulation of Projectiles

The present invention has the ability to simulate effects of an area weapons system which launches projectiles at ground targets. These projectiles include mortars, rockets, missiles, artillery, smart bombs, etc. Projectiles that are launched against airborne targets will be discussed further below in a separate discussion.

The basic operation of the present invention with regard to projectiles is essentially the same as for minefields with the following significant differences. Weapons areas associated with projectiles are typically defined some relatively short time after a commander calls for a strike. The present invention preferably allows both the players who will encounter the weapons area, as well as the commander who orders the strike to be trained. Therefore, in accordance with one embodiment of the present invention, when a player acting as commander orders a strike, there is an approval process that must be either simulated or enacted by other players.

The approval process can be simulated by having the commander call for a strike as he or she would during an actual battle. The information provided by the commander is then entered into the central computer 101 (preferably by someone playing the role of the officer who takes commands from the commander). Based on the information entered, the central computer 101 determines the location of a projectile weapons area 102, the type of projectile that is to be simulated, the number of projectiles that are to be simulated, and the time at which the projectiles will begin striking the weapons area. In the case of projectiles that are to be fired in volleys, the time of each volley, the number of projectiles per volley, and the amount of time between each volley will also be determined by the central computer 101. This information is then broadcast to each of the Player Units 105. In an alternative embodiment of the present invention, depending upon the objectives of the training exercise, the commander may define all of the parameters which are to be considered, such as how many rounds to be included in each volley, how many volleys are to be fired, etc. In accordance with one embodiment, the central computer 101 places limits on the commander to ensure that maximum values are not exceeded. For example, some weapons require a predetermined reload time, and thus the maximum number of rounds that can be launched in a predetermined time is limited by both the number of weapons available and the capability of the particular weapons. In addition, a reload time is preferably considered in determining the maximum number of rounds that can be fired within a particular amount of time.

The central computer 101 accounts for delays in the approval process when determining the time at which the projectiles will begin landing within the weapons area 102. Once the Player Units 105 receive the information from the central computer 101, they determine whether the player to which the Player Unit 105 has been assigned has been affected by a projectile. In accordance with one embodiment of the present invention, in order to simulate individual projectiles landing at different times, each Player Unit 105 determines whether the player has been hit by a projectile a random period of time after the time at which the projectiles begin landing within the weapons area 102. Therefore, each Player Unit 105 will determine whether the player to which the Player Unit 105 has been assigned has been affected by a projectile, and all of the Player Units 105 within the same weapons area 102 will alert the players at random times for each simulated volley of projectiles. If a player leaves the weapons area 102 before the Player Unit 105 has determined whether the player has been hit, the Player Unit 105 takes no further action (i.e., there is no consequence to the player leaving the weapons area 102).

In addition to calculating a time of flight delay which accounts for the amount of time required for a projectile to reach a weapons area once released, the present invention may account for weather conditions in determining both the accuracy of the weapon (i.e., the size and shape of the weapons area and the density as a function of the number of projectiles that are launched and the total area into which the projectiles will fall) and the time of flight. These considerations allow the present invention to accurately simulate battle conditions, and thus provide more valuable training.

The probability that a player will be affected by a projectile can be modified as a function of action taken by the player and/or by equipment which the player has available. The probability that a player will be affected by a projectile can be modified as a function of whether the player is upright or prone. In addition, if a player is within a predetermined distance of a vehicle or structure that has been determined to have been hit by a projectile, the Player Unit 105 assigned to that vehicle or structure reports to the central computer 101, which in turn sends a message to any Player Unit 105 assigned to a player that is in, or in close proximity to, the vehicle or structure. Thus, the present invention accounts for collateral damage and takes in to account that players may be inside a structure or vehicle. For example, a player inside a tank may survive an artillery barrage if the tank does not sustain a direct hit.

In addition, the probability that a player will be affected by a projectile will preferably be greater for the first volley of an artillery or mortar attack, since the players will typically take action to reduce their vulnerability once the attack begins The present invention also has the ability to "suppress" soldiers that are within a weapons area 102 that is actively receiving projectiles. Suppressing soldiers preferably includes at least preventing soldiers from discharging their weapons. The duration of the period of time during which soldiers are to be suppressed preferably is programmable, but may be determined as a fixed parameter determined by statistical data.

The present invention can be adapted to simulate smart bombs. Smart bombs can be guided to a target, and thus are more accurate than unguided projectiles. Therefore, the probability that the smart bombs will find their targets is greater. Accordingly, the weapons area 102 that is defined for a smart bomb is typically relatively small and the probability that the weapon will affect players in the weapons area is very high.

The central computer 101 determines which targets have been selected to be affected by a smart bomb. These targets are then alerted at the appropriate time that a smart bomb has struck the vehicle. The vehicle that has been affected by the smart bomb reports back to the central computer 101 with a message that indicates the location of the vehicle at the time the vehicle was struck. The central computer 101 then calculates a weapons affect area 102 that is used to determine the associated collateral damage. This area 102 is transmitted to each of the Player Units 105. Each Player Unit 105 then determines whether the associated player is within the area 102 and the result based on probabilities associated with the area 102 as transmitted by the central computer 101.

Since projectiles have the ability to affect structures, as well as equipment and personnel, the present invention allows Player Units 105 to be assigned and physically secured to structures, such as bridges, buildings, and obstacles that might impede the movement of personnel and equipment. These Player Units 105 preferably operate in the same way as Player Units 105 that are assigned to, and carried by, vehicles and personnel. The capability of all Player Units 105 is preferably identical, thus allowing for lower cost manufacture and greater economy of scale. Accordingly, a Player Unit 105 can be placed at the location of a structure without the need to program the location of the structure into the Player Unit 105. The Player Unit 105 need only be assigned to the structure in order to determine the particular table of damage that should be used in determining the effect of being hit by a projectile. Once a weapons area has been defined and transmitted to the Player Units 105, the Player Unit 105 assigned to the structure determines the effect of the weapon on the structure in the same manner as described above with regard to mobile Player Units 105.

In accordance with an alternative embodiment of the present invention, the location determining equipment 307 (FIG. 3) is not provided with Player Units 105 assigned to stationary, i.e. non-mobile structures. Instead, the location of the structure is programmed into the Player Unit 105 when the Player Unit 105 is placed on the structure. When the Player Unit 105 receives information indicating that a weapons area has been defined to include the location of the structure to which the Player Unit 105 is assigned, the Player Unit 105 determines the effect of the weapon on the structure in the same way as described above with regard to mobile Player Units.

Simulation of Air Defense Systems

The present invention also has the ability to simulate air defense systems, such as batteries of anti-aircraft guns and surface-to-air missiles. In the case of air defense simulations, the present invention defines a "dome of fire" in which simulated air defense weapons have the ability to affect aircraft, including fixed wing aircraft and helicopters. As is the case in simulating projectiles and minefields, the dome of fire is defined by entering information into the central computer 101 . This information is used to define a volume of space in which air defense weapons can affect aircraft that fly through the dome of fire. The dome of fire can be defined as a simple geometric shape, such as a half sphere, or as a more complex geometric shape formed as a composite of simple geometric shapes. Alternatively, the dome of fire can be defined by locating a number of points on the surface of the dome. In addition, the user entering the information into the central computer 101 can select from a menu of predefined shapes for the dome of fire. These shapes can then be manipulated either mathematically or graphically in order to define a desired dome of fire.

Aircraft are each assigned and carry a Player Unit 105 which is essentially the same as the Player Units 105 assigned to ground personnel, vehicles, and structures. When the location determining equipment in the airborne Player Unit 105 determines that the player to which the Player Unit 105 has been assigned has entered into a dome of fire, the Player Unit 105 begins calculating whether the player has been affected by the weapons associated with the dome of fire, in the same way that entry into a weapons area 102 causes a Player Unit 105 to begin calculating the effect of a weapon on the ground. Furthermore, the Player Unit 105 will respond to a weapons area 102 being defined while the aircraft is on the ground in the same way as any other Player Unit 105 that is within a weapons area 102. Calculations as to the probability of damage and the possibility of collateral damage due to an adjacent aircraft being hit are made by the Player Unit 105.

When a player enters an aircraft, either a training administrator or the Player Unit 105 assigned to the player preferably reports to the central computer 101 to log the player into the aircraft. The central computer 101 stores information that the player has entered the aircraft so that the player can be notified of any possible consequence if the aircraft is hit by an air defense weapon. Depending upon the damage that is done to the aircraft, the player may either be removed from the simulation or a casualty assessment will be performed by the Player Unit 105 assigned to the player to determine the nature of any injury that the player is to sustain as a consequence of the aircraft being damaged.

As is the case for projectiles fired at ground targets, air defense weapons have practical limits as to the number of rounds that can be fired within a set amount of time. This is preferably taken into account by the present invention by setting limits on the number of rounds that can be fired (i.e., the probability calculations are determined based upon numbers which do not exceed the maximum allowable number of rounds possible). In addition, delays due to time of flight and fire control approval are simulated in essentially the same manner as for projectiles. Also, Player Units 105 apply a short random delay to the time that a volley of air defense rounds are fired similar to that described above with respect to projectiles in order to simulate that the rounds are fired over a period of time and not all at one time.

Simulation of Toxic or Nuclear Clouds

In addition to simulating minefields, projectiles, and air defense weapons, the present invention can be used to simulate toxic or nuclear clouds. Toxic clouds include chemical and biological agents which may kill, injure or sicken troops. In accordance with the preferred embodiment of the present invention, weather conditions, such as wind speed, humidity, and other such factors, are measured with conventional instruments to allow such weather conditions to be considered in determining the movement of a toxic or nuclear clouds. Alternatively, the movement of such clouds can be predetermined and unchanging with regard to weather. In yet another alternative embodiment of the present invention, rather than measuring the actual weather conditions, the central computer 101 or a user selects a set of weather conditions which may or may not correspond to the actual weather conditions occurring during the exercise.

In any case, a cloud is first defined by the user through entry of information into the central computer 101. This information includes the type of weapon, the target, the delivery system to be used, and other such information required for the central computer to determine the initial characteristics and location of the cloud that will form as a result of a cloud forming weapon. The particular cloud forming weapon may be selected from a menu which includes a wide variety of weapons and associated delivery systems, including nuclear bombs, gas canisters, gas grenades, chemical warheads mounted on missiles or rockets, etc.

A commander of the simulation initiates an attack by ordering the use of the selected weapon. For example, a commander may order a nuclear bomb to be dropped on a particular target location at a particular time. If the time that is specified is sufficiently distant in the future, then the central computer 101 will broadcast to all Player Units 105 a message that includes initial coordinates of the nuclear cloud that is released by the detonation of the bomb. The initial coordinates will take into account the requested target location and the accuracy of the delivery system used. Sophisticated algorithms may be used to determine the probability that the bomb will land within a particular range of the target location if the effect of the weapon is relatively small with respect to the accuracy with which the weapon can be delivered. However, in the case of a weapon that affects a relatively large area, the accuracy of the weapon may be insignificant with respect to the effect, and thus need not be considered.

The initial location, size and shape of the cloud that is formed can be defined by any one or combination of techniques, such as: providing points along the perimeter of the cloud; selecting a shape from a menu or table of shapes; selecting a scaling factor; selecting a combination of shapes to be overlaid in a selected manner; or by defining a mathematical formula which defines the location of points on the perimeter of the cloud. It should be understood that other means for defining the location, size, and shape of the cloud may be used. Tradeoffs between the amount of data that must be transmitted, the accuracy of the model, and the ease of entry of the data by the user will typically determine the particular implementation of the data entry scheme to be used.

As the time between the initial release of the cloud passes, the location, size, and shape of the cloud changes. In accordance with one embodiment of the present invention, these changes are implemented by broadcasting new information regarding the cloud at regular intervals (i.e., superseding the old definition of the cloud with a new definition that takes into account the movement of the cloud). Alternatively, the central computer 101 broadcasts information as to how the cloud will move together with the initial information regarding the size, shape, and location thus allowing each Player Unit 105 to calculate the movement of the cloud without the need for the central computer 101 to broadcast new information. It should be understood that the movement of an actual cloud will depend at least on the type of cloud and the weather conditions. Predicting the movement of a cloud is a relatively complex matter. However, simplifications may be acceptable for the purposes of a training exercise. Nonetheless, it should be understood that such complexities may be accounted for in the present invention by updating the location, size, and shape of the cloud with new location, size, and shape information as required.

In addition to changes in the location, size, and shape of the cloud, changes in the effect that the cloud will have occur as time passes due to the cloud dispersing over time. Therefore, for those players that are close to the target location, the effect will be greater than for those players that are at a distance but within the range of the weapon. Therefore, as the location, size, and shape of the cloud changes, the effect of the cloud may be changed. Both the probability that a player will be affected and the nature of the effect may be changed as the size and shape of the cloud change. This change may be implemented by having the central computer 101 broadcast to each Player Unit 105 updates to the probability that a player within the cloud will be affected. Player Units 105 that determine that they are within the cloud use the updated probability to determine whether the player has been affected by the cloud. Each Player Unit 105 randomly selects from among a list of injuries to determine the particular injury that will be sustained by a player to which that Player Unit 105 has been assigned.

Each Player Unit 105 may be pre-loaded with all the information that is required to determine the probability that the player will be affected by the cloud. In addition, the types of injuries that are likely to be sustained may be stored within each Player Unit 105. When a Player Unit 105 first determines that the player to which the Player Unit 105 has been assigned has entered a cloud, the Player Unit 105 may determine the type of weapon that has created the cloud, the time at which the cloud was initially created, the initial location of the cloud, and any defensive measures that the player has taken to defend against the cloud (such as donning a gas mask before entering the cloud, etc). This information is then used to determine the probability that the player will be affected by the cloud. If the cloud remains relatively concentrated and the player has not taken sufficient measures to defend against the cloud, then the probability that the player will be affected by the cloud is very high (and may even be considered to be 100%). If the Player Unit 105 determines that the player has been affected by the cloud, the particular effect is determined by referring to a table that corresponds to the type of weapon that has created the cloud, the time at which the cloud was initially created, the initial location of the cloud, and any defensive measures that the player has taken to defend against the cloud. The particular entry to the table is preferably selected by a probabilistic determination as to which injury is most likely. However, in an alternative embodiment of the present invention, the particular injury is selected from the table at random.

Conclusion

A number of embodiments of the present invention have been described. Nevertheless, it will be understood by those skilled in the art that various modifications may be made without departing from the spirit and scope of the present invention. For example, the particular manner in which information is entered and/or received by the central computer 101 and the Player Units 105 may vary significantly from the ways described herein. More particularly, the data may be transmitted to the central computer 101 from a tape or diskette which stores preprogrammed exercises. In addition, the Player Units 105 may be programmed by the player to whom they are assigned. In addition, the manner in which the probability that a player will be affected is determined may vary significantly from that described herein. The central computer 101, control/relay stations 103 and Player Units 105 all have stored operational programs that allow them to execute the functions described. Accordingly, it is to be understood that the invention is not to be limited by the specific illustrated embodiments, but only by the scope of the appended claims.

What is claimed is:

1. An area weapons effect simulation system for simulating the effects of weapons on players, comprising:

means for specifying a definition of at least one weapons area to include information defining a perimeter and information for defining a type of weapon and a terrain associated with the weapons area;

means for transmitting a definition of the weapons area, at least one player unit assigned to a player, including means for receiving the definition of the weapons area, location determination equipment for determining the location of the player unit, a processor that compares the location of the player unit to the perimeter of the weapons area to determine whether the player assigned to the player unit will be affected by the type of weapon associated with the weapons area, and a memory for storing casualty probability information specifying an effect on the player of the weapon associated with the weapons area responsive to the location of the player unit; and means for adjusting the relocation time interval between successive determinations of the player unit location responsive to the location of the player unit.

2. The area weapons effect simulation system of claim 1, further comprising:

at least one supervisor player unit assigned to a supervisor, including means for transmitting supervisory changes to the casualty probability information stored in the player unit assigned to the player; and means in the player unit for receiving the supervisory changes to the casualty probability information and for modifying the stored casualty probability information accordingly.

3. The area weapons effect simulation system of claim 2, further comprising:

means for adjusting the effect on the player of the weapon associated with the weapons area responsive to the terrain at the location of the player unit assigned to the player.

4. The area weapons effect simulation system of claim 3, further comprising:

at least one structure player unit assigned to a structure or vehicle, including means for receiving the definition of the weapons area, location determination equipment for determining the location of the structure player unit, a processor that compares the location of the structure player unit to the perimeter of the weapons area to determine whether the structure or vehicle assigned to the structure player unit will be affected by the type of weapon associated with the weapons area, a memory for storing structure casualty probability information specifying an effect of the weapon associated with the weapons area on the structure or vehicle responsive to the location of the structure player unit, and means for transmitting to the player unit the effect of the weapon associated with the weapons area on the structure or vehicle; and means for adjusting the effect on the player of the weapon associated with the weapons area responsive to the effect of the same weapon on the structure or vehicle.

5. The area weapons effect simulation system of claim 4, further comprising:

second transmission means in the player unit for transmitting the effect on the player of the weapon associated with the weapons area; and second receiver means for receiving the weapon effect on the player transmitted by the second transmission means.

6. The area weapons effect simulation system of claim 1, further comprising:

means for adjusting the effect on the player of the weapon associated with the weapons area responsive to the terrain at the location of the player unit assigned to the player.

7. The area weapons effect simulation system of claim 1, further comprising:

at least one structure player unit assigned to a structure or vehicle, including means for receiving the definition of the weapons area, location determination equipment for determining the location of the structure player unit, a processor that compares the location of the structure player unit to the perimeter of the weapons area to determine whether the structure or vehicle assigned to the structure player unit will be affected by the type of weapon associated with the weapons area, a memory for storing structure casualty probability information specifying an effect of the weapon associated with the weapons area on the structure or vehicle responsive to the location of the structure player unit, and means for transmitting to the player unit the effect of the weapon associated with the weapons area on the structure or vehicle; and means for adjusting the effect on the player of the weapon associated with the weapons area responsive to the effect of the same weapon on the structure or vehicle.

8. A minefield simulation system for use in training, comprising:

a central computer for receiving and storing information regarding a definition of a simulated minefield, including a plurality of associated mines and an associated terrain, and for communicating the information to a plurality of player units each associated with a corresponding player that may traverse the simulated minefield;

each player unit including a receiver for receiving the information regarding the definition of the simulated minefield, location determination equipment for determining a location of the receiver, a memory for storing casualty probability information specifying an effect on the player of the mines associated with the simulated minefield responsive to the location of the player unit, a processor for comparing the location of the receiver with the definition of the simulated minefield to determine an effect on a player assigned to the receiver of the mines associated with the simulated minefield within which the player is located, and a transmitter for transmitting to the central computer information as to the effect of the mines associated with the simulated minefield on the player assigned to the player unit; and means for adjusting the relocation time interval between successive determinations of the receiver location responsive to the location of the receiver.

9. The minefield simulation system of claim 8, further comprising:

at least one supervisor player unit assigned to a supervisor, including means for transmitting supervisory changes to the casualty probability information stored in the player unit assigned to the player; and means in the player unit for receiving the supervisory changes to the casualty probability information and for modifying the stored casualty probability information accordingly.

10. The minefield simulation system of claim 9, further comprising:

means for adjusting the effect on the player of the mines associated with the simulated minefield responsive to the terrain at the location of the player unit assigned to the player.

11. The minefield simulation system of claim 10, further comprising:

at least one structure player unit assigned to a structure or vehicle, including means for receiving the definition of the simulated minefield, location determination equipment for determining the location of the structure player unit, a processor that compares the location of the structure player unit to the perimeter of the simulated minefield to determine how the structure or vehicle assigned to the structure player unit is affected by the mines associated with the simulated minefield, a memory for storing structure casualty probability information specifying an effect of the mines associated with the simulated minefield on the structure or vehicle responsive to the location of the structure player unit, and means for transmitting to the player unit the effect of the mines associated with the simulated minefield on the structure or vehicle; and means for adjusting the effect on the player of the mines associated with the simulated minefield responsive to the effects of the same mines on the structure or vehicle.

12. The minefield simulation system of claim 8, further comprising:

means in the central computer for receiving information from the player unit and for changing the definition of the minefield to remove areas that have been traversed by the player.

13. The minefield simulation system of claim 8, further comprising:

means for adjusting the effect on the player of the mines associated with the simulated minefield responsive to the terrain at the location of the player unit assigned to the player.

14. The minefield simulation system of claim 8, further comprising:

at least one structure player unit assigned to a structure or vehicle, including means for receiving the definition of the simulated minefield, location determination equipment for determining the location of the structure player unit, a processor that compares the location of the structure player unit to the definition of the simulated minefield to determine how the structure or vehicle assigned to the a structure player unit is affected by the mines associated with the simulated minefield, a memory for storing structure casualty probability information specifying an effect of the mines associated with the simulated minefield on the structure or vehicle responsive to the location of the structure player unit, and means for transmitting to the player unit the effect of the mines associated with the simulated minefield on the structure or vehicle; and means for adjusting the effect of the mines associated with the simulated minefield on the player responsive to the effects of the same mines on the structure or vehicle.

15. A method for simulating area effects of weapons on a plurality of players in a military combat training exercise, comprising the steps of:

defining at least one weapons area to include information defining a perimeter and information for determining a terrain and a type of weapon associated with the weapons area;

transmitting a definition of the weapons area to a plurality of player units each assigned to a corresponding player;

storing player casualty probability information specifying an effect on the assigned player of the weapon associated with the weapons area responsive to the location of the player unit;

determining the location of each player unit;

determining at each player unit the casualty probability information corresponding to the weapon associated with the weapons area and the location of the assigned player within the weapons area;

determining an effect of the weapon on each player based on the corresponding casualty probability information for the player; and adjusting independently for each player unit the time interval between successive determinations of player unit location responsive to the player unit location.

16. The method of claim 15 further comprising the steps of:

monitoring the behavior of a player assigned to a first player unit;

transmitting changes to the casualty probability information associated with the first player unit responsive to the monitored player behavior; and receiving the changes to the casualty probability information at the first player unit and modifying the casualty probability information stored therein.

* * * * *